United States Patent [19]

Stewart

[11] Patent Number: 4,781,577

[45] Date of Patent: Nov. 1, 1988

[54] FUEL BOTTLE WITH CANDLE-LIKE ATTACHMENT

[76] Inventor: Jeff Stewart, 13335 Wildcrest Dr., Los Altos, Calif. 94022

[21] Appl. No.: 30,182

[22] Filed: Mar. 26, 1987

[51] Int. Cl.[4] ..... F23D 3/24

[52] U.S. Cl. ..... 431/320

[58] Field of Search ..... 431/320–325, 431/313, 34, 343, 146, 344, 144; 126/96, 260, 265

[56] References Cited

U.S. PATENT DOCUMENTS

| | | | |
|---|---|---|---|
| 914,900 | 3/1909 | Turner et al. | 431/324 |
| 1,610,301 | 12/1926 | McCloskey | 431/321 |
| 2,512,885 | 6/1950 | Archambeau | 431/321 |
| 3,363,436 | 1/1968 | Rutesic | 431/321 |
| 4,526,530 | 7/1985 | Menter et al. | 431/321 |

*Primary Examiner*—James C. Yeung

*Attorney, Agent, or Firm*—Townsend & Townsend

[57] ABSTRACT

An improved liquid fuel bottle having an upper neck which removably receives a top for closing the bottle to contain the liquid fuel therewithin. The bottle includes a candle-like attachment for the neck of the bottle in which the attachment can be connected directly to the bottle neck and the top can be connected directly to the upper end of the attachment. A wick is adjustably carried by a member forming part of the attachment for vertical adjustment with respect to the main body of the attachment. The wick is arranged so that, when the attachment is coupled to the neck of the bottle, the wick extends downwardly into the liquid fuel contained in the bottle. Once the attachment is on the bottle, the top can be coupled to the upper end of the attachment to close the bottle. The wick is exposed upon removal of the top to permit and the upper end of the wick can then be ignited. In this way, the wick can serve as a candle yet the liquid fuel source capability of the fuel bottle is still intact.

16 Claims, 1 Drawing Sheet

FUEL BOTTLE WITH CANDLE-LIKE ATTACHMENT

This invention relates to improvements in fuel bottles and, more particularly, to a fuel bottle having a attachment thereon for forming a light source.

BACKGROUND OF THE INVENTION

Fuel bottles for supplying fuel to camping stoves and lamps have been known and used in the past. Typically, these fuel bottles are made of metal and have an internally threaded neck for receiving an externally threaded top for closing and sealing the upper end of the bottle. Such fuel bottles are generally limited to a single use, such as providing a fuel source for a camp stove or a lamp, it is desirable that such a fuel bottle be suitable for other purposes as well, such as a source of light.

Prior art in the field of lamps fed by liquid fuel include U.S. Pat. Nos. 3,081,612, 4,477,247 and 4,563,150.

U.S. Pat. No. 3,081,612 discloses an artificial candle having a wick 35 in a bottle 11. A top 31 is threaded on a wick holder 19 for adjusting the flame as desired. The bottle has a hole 27 for use in filling the bottle. Top 31 is fixed in place on the upper end of a decorative sleeve.

U.S. Pat. No. 4,477,247 shows a torch in vertical section (FIG. 2). Liquid fuel is contained in a bottle 12 and a wick 70 extends into the fuel and terminates at the upper end thereof in a space defined by a ring 40 so that the upper end of the wick can be ignited.

U.S. Pat. No. 4,563,150 shows a light source using liquid fuel and having a burner provided with a wick 22. The burner is arranged to co-act with a shield 24 which permits the flame to burn freely.

None of the foregoing disclosures teaches or suggests a fuel bottle which can also serve as a light source or candle. Thus, a need exists for an improved fuel bottle which can serve this purpose and the present invention satisfies this need.

SUMMARY OF THE INVENTION

The present invention is directed to an improved liquid fuel bottle which has an upper neck which normal removably receives a top for closing the bottle to contain the liquid fuel therewithin. The present invention includes a candle-like attachment for the neck of the fuel bottle in which the attachment can be connected directly to the bottle neck and the top can be connected directly to the upper end of the attachment. A wick is adjustably carried by a member forming part of the attachment for vertical adjustment with respect to the main body of the attachment. The wick is arranged so that, when the attachment is coupled to the neck of the bottle, the wick extends downwardly into the liquid fuel contained in the bottle. Moreover, once the attachment is on the bottle, the top can be coupled to the upper end of the attachment to close the bottle. The wick is exposed upon removal of the top to permit and the upper end of the wick can then be ignited. In this way, the wick can serve as a candle yet the liquid fuel source capability of the fuel bottle is still intact inasmuch as the attachment can be removed from the neck of the bottle when it is desired to use some of the fuel for other purposes, such as for a camp stove and the like.

The primary object of the present invention is to provide an improved attachment for a fuel bottle having a neck and a top for closing the neck wherein the attachment has a wick which is adjustably carried by a member shiftably coupled on the body of the attachment so that when the attachment is on the bottle, the wick will extend into the liquid fuel in the bottle and the upper end of the wick can be ignited so that the attachment permits the bottle to serve as a candle yet the bottle can continue to be a source of liquid fuel for other equipment, such as camp stoves and the like.

Another object of the present invention is to provide a liquid fuel bottle having an attachment thereon for converting the liquid fuel bottle into a candle or light source yet the bottle can be closed with a top while the attachment is still coupled to the bottle and the attachment can be removed from the bottle to allow liquid fuel to be poured from the bottle.

Other objects of this invention will become apparent as the following specification progresses, reference being had to the accompanying drawings for an illustration of the invention.

In the Drawings

Figure 2:
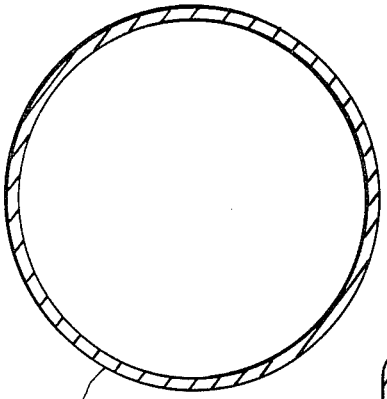
FIG. 2 is a cross-sectional view taken along line 2—2 of FIG. 1.

The fuel bottle assembly of the present invention is broadly denoted by the numeral 10 and includes a fuel bottle 12 adapted to contain a quantity of liquid fuel 14, such as the type of fuel for cooking stoves used on camping outings. Bottle 12 typically is cylindrical in cross-section as shown in FIG. 2 and has a tapered upper part 16 and an internally threaded neck 18 having a flange 20 surrounding the upper portion of the neck. Bottle 12 has a top 22 with an externally threaded lower body part 24 and a cap-like upper part 26 provided with a hole 28 there through. Top 22 is provided with a resilient seal 29 and a lower part 24 is normally threaded into the internally threaded neck 18 of the bottle to close the bottle. Seal 29 prevents fuel from leaking at the interface between top 22 and neck 18.

Bottle 12 and top 22 are commercially available at various camping equipment outlets. Typically, bottle 12 is of metallic material, such as a suitable steel. Top 22 typically is of a plastic material which is molded. The top is easily threaded onto neck 18 of bottle 12.

A candle-forming attachment 30 includes an upper part 32 which is internally threaded at 34 to threadably receive the lower portion 24 of top 22. Attachment 30 further includes an externally threaded lower part 36 which is capable of being threadably mounted in neck 18.

Figure 1:
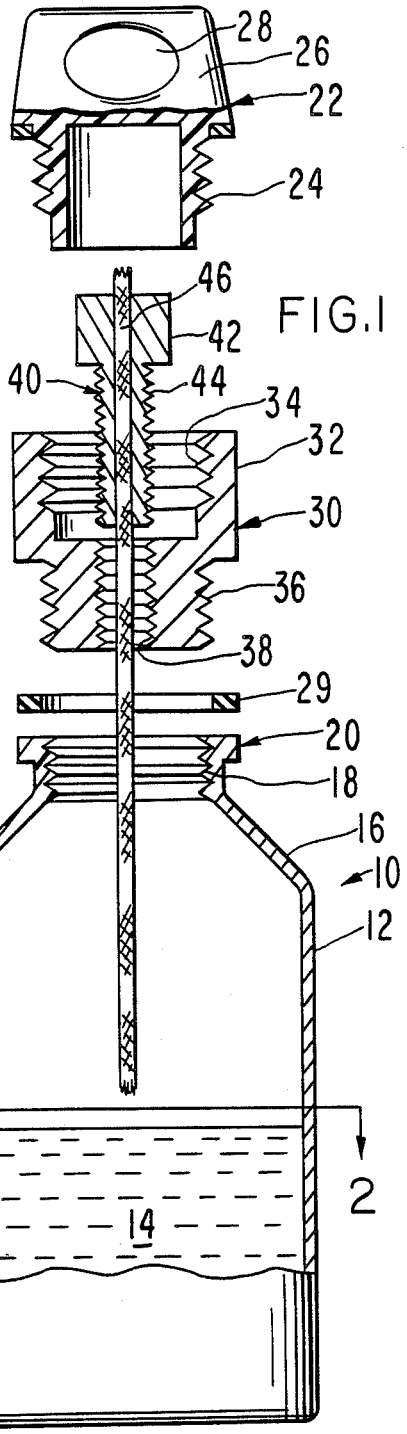
FIG. 1 is a vertical section of the fuel bottle with the candle-like attachment of the present invention.

Lower part 36 of attachment 30 has a central, internally threaded bore 38 for threadably receiving an elongated, externally threaded member 40 having a head like element 42 at the upper end thereof. Member 40 and element 42 have a central bore 44 therethrough for frictionally holding a wick 46 which is long enough to extend downwardly from member 40 when the member is threadably coupled in bore 38 so that the wick will be immersed in liquid fuel 14 in bottle 12. The wick projects upwardly from the upper surface of element 42 as shown in FIG. 1; thus, the wick can be ignited to produce a flame for serving as a candle or a light source.

To construct assembly 10, lower part 36 of attachment 30 is directed through the central hole of seal 29 and then threaded into neck 18. Wick 46 is then placed through member 40 and element 42 and then through central bore 38 and into bottle 12. Member 40 is then threaded into bore 38 until element 42 is within the confines of upper part 32 of attachment 30. Then, top 22 can be placed on the assembly with the lower part 24 of top 22 threaded into the upper part 32 of attachment 30. When fully assembled, assembly 10 has the appearance shown in FIG. 4 with top 22 properly closing the bottle so as to retain the contents of the bottle therewithin.

Figure 3:
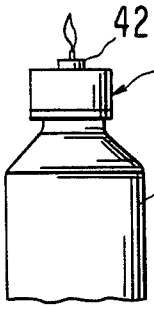
FIG. 3 is a side elevational view, on a reduced scale, of the fuel bottle showing the top removed and the candle attachment provided with a flame thereon.

When it is desired to use the assembly as a candle, top 22 is removed and the exposed upper part of the wick is ignited with a match or lighter so that a flame can burn on the tip of the wick as shown in FIG. 3. The flange will thereby provide a light source or candle which can continue to burn until extinguished or until the fuel supply in the bottle is depleted. The size of the flame can be adjusted by adjusting the position of member 40 in bore 38. For a larger flame, the member 40 is slightly elevated so that the upper part of element 42 is exposed as shown in FIG. 3. To protect the flame from the wind, the member 40 is caused to extend deeper into bore 38 so that the upper surface of element 42 is below the upper surface of attachment 30.

Figure 4:
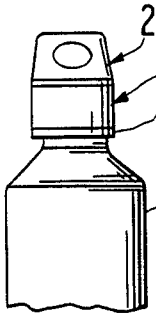
FIG. 4 is a view similar to FIG. 3 but showing the top in place on the candle attachment.

After use of the assembly 10 as a candle, the flame is extinguished and top 22 is once again put in the plate. The hollow interior of lower part 24 of top 22 allows element 42 to nest within lower part 24 when top 22 is in place on the bottle as shown in FIG. 4.

I claim:

1. In a fuel bottle having a neck and a top threadably mounted on the neck: a candle-like attachment for the neck of the bottle, said attachment having a body provided with a lower part and a hollow upper part, the lower part having a central bore there through, the lower part of the body being threaded and coupled to the neck of the bottle, the upper part of the body being threaded to receive the lower end of the top to close the bottle when the attachment is coupled to the neck thereof, there being a threaded member extending through and coupled to the body, and a wick carried by the member, and said wick extend into the bottle and into the fuel carried thereby when the attachment is coupled to the neck of the bottle.

2. In a fuel bottle as set forth in claim 1, wherein the lower part of the attachment is externally threaded and the upper part of the body is internally threaded.

3. In a fuel bottle as set forth in claim 1, wherein said bore is internally threaded and said member is externally threaded.

4. In a fuel bottle as set forth in claim 1, wherein the member has an element on the upper end thereof, said element adapted to be adjustably movable into and partially out of the upper part of the body, the upper end of the wick normally projecting upwardly from the upper end of the element.

5. In a fuel bottle as set forth in claim 1, wherein the upper part of the body is internally threaded to threadably receive the lower end of the top.

6. In a fuel bottle as set forth in claim 1, wherein said attachment has means for removably mounting the same on the neck of the bottle.

7. In a fuel bottle as set forth in claim 1, wherein said member is adjustable in said attachment body to adjust the height of the flame burning at the end of the wick.

8. In a fuel bottle as set forth in claim 1, wherein the member has a cylindrical upper element thereon, said element being adjustably receivable within the upper part of the attachment body to thereby permit variations in the size of the flame on the upper end of the wick.

9. A fuel bottle having a neck and a top threadably mounted on the neck; and a candle attachment for the neck of the bottle, said attachment having a body provided with a lower part and a hollow upper part, the lower part having a central bore there through, the lower part of the body being threaded and connected to the neck of the bottle, the upper part of the body being threaded to receive the lower end of the cap to close the bottle when the attachment is coupled to the neck thereof, there being a threaded member extending through and coupled to the body, and a wick carried by the member, and said wick extend into the bottle and into the fuel carried thereby when the attachment is couple to the neck of the bottle.

10. In a fuel bottle as set forth in claim 9, wherein the lower part of the attachment is externally threaded and the upper part of the body is internally threaded.

11. In a fuel bottle as set forth in claim 9, wherein said bore is internally threaded and said member is externally threaded.

12. In a fuel bottle as set forth in claim 9, wherein the member has an element on the upper end thereof, said element being generally cylindrical and adjustably movable into and partially out of the upper part of the attachment body, the upper end of the wick projecting upwardly from the upper end of the element.

13. In a fuel bottle as set forth in claim 9, wherein the upper part of the body is internally threaded to threadably receive the lower end of the cap.

14. In a fuel bottle as set forth in claim 9, wherein said attachment has means for removably mounting the same on the neck of the bottle.

15. In a fuel bottle as set forth in claim 9, wherein said member is adjustable in said attachment to adjust the height of the flame burning at the end of the wick.

16. In a fuel bottle as set forth in claim 9, wherein the member has a cylindrical upper element thereon, said element being adjustably receivable within the upper part of the attachment to thereby permit variations in the size of the flame on the upper end of the wick.

* * * * *